US007024823B2

(12) United States Patent
Keller

(10) Patent No.: US 7,024,823 B2
(45) Date of Patent: Apr. 11, 2006

(54) SENTINEL EVENT REDUCTION SYSTEM

(75) Inventor: Patrick Keller, Chesapeake, VA (US)

(73) Assignee: The Pines Residential Treatment Center, Inc., Portsmouth, VA (US)

( * ) Notice: Subject to any disclaimer, the term of this patent is extended or adjusted under 35 U.S.C. 154(b) by 237 days.

(21) Appl. No.: 10/799,971

(22) Filed: Mar. 12, 2004

(65) Prior Publication Data

US 2005/0198910 A1 Sep. 15, 2005

(51) Int. Cl.
*E05D 7/00* (2006.01)
*E06B 3/00* (2006.01)

(52) U.S. Cl. ..... 49/399; 49/501; 256/73

(58) Field of Classification Search ..... 49/399, 49/381, 383, 501, 161, 168; 52/106, 239; 256/59, 26, 73; 109/74, 75, 58.5, 64, 69, 109/73, 77, 78
See application file for complete search history.

(56) References Cited

U.S. PATENT DOCUMENTS

| | | | | | |
|---|---|---|---|---|---|
| 157,505 | A | | 6/1874 | Fletcher | |
| 164,566 | A | | 6/1875 | Kissam | |
| 606,724 | A | * | 7/1898 | Lucas | 49/381 |
| 1,259,358 | A | | 3/1918 | Carpenter | |
| 1,311,229 | A | | 7/1919 | Hughes | |
| 1,637,145 | A | | 7/1927 | Hart et al. | |
| 2,175,717 | A | | 10/1939 | Kerr | |
| 2,232,184 | A | * | 2/1941 | Morrison | 49/144 |
| 2,240,482 | A | | 5/1941 | Anderson | |
| 2,268,264 | A | | 12/1941 | Nimick et al | |
| 2,776,029 | A | | 1/1957 | Hult | |
| 3,056,475 | A | | 10/1962 | Benham | |
| 3,060,523 | A | * | 10/1962 | Benham | 49/381 |
| 3,075,234 | A | * | 1/1963 | Speakman | 49/383 |
| 3,194,362 | A | | 7/1965 | Wargo | |
| 3,212,561 | A | | 10/1965 | Eckel | |
| 3,232,013 | A | | 2/1966 | Dow | |
| 3,242,619 | A | | 3/1966 | Parsons | |
| 3,715,847 | A | | 2/1973 | Straus | |
| 3,813,836 | A | | 6/1974 | Dielman | |
| 3,824,747 | A | | 7/1974 | Zehner, Jr. | |
| 3,842,556 | A | | 10/1974 | Brendgord | |
| 3,860,138 | A | * | 1/1975 | Lovich et al. | 49/197 |
| 3,953,949 | A | * | 5/1976 | O'Sheeran | 52/82 |
| 4,084,347 | A | | 4/1978 | Brown | |
| 4,478,019 | A | | 10/1984 | Thompson, Jr. | |
| 4,850,142 | A | * | 7/1989 | Sasamura et al. | 49/381 |
| 5,046,635 | A | * | 9/1991 | Haas et al. | 220/254 |
| 5,131,188 | A | * | 7/1992 | Hutchison et al. | 49/404 |
| 5,184,423 | A | | 2/1993 | McCarty | |
| 5,367,844 | A | | 11/1994 | Diedrich | |
| 5,459,972 | A | | 10/1995 | Eckel | |
| 5,592,787 | A | | 1/1997 | Ophardt | |
| 5,630,302 | A | | 5/1997 | Rosenband | |
| 5,711,121 | A | | 1/1998 | Garver | |
| D424,667 | S | | 5/2000 | Ariza et al. | |
| 6,151,841 | A | * | 11/2000 | Green | 52/79.4 |
| 6,385,909 | B1 | * | 5/2002 | Marsh et al. | 49/169 |
| 6,622,432 | B1 | * | 9/2003 | Zacher et al. | 49/501 |

* cited by examiner

*Primary Examiner*—Hugh B. Thompson, II
(74) *Attorney, Agent, or Firm*—John H. Thomas, P.C.

(57) ABSTRACT

A sentinel event reduction door comprises a trapezoidally-shaped panel comprising four sides. A continuous hinge is connected to the panel along substantially the full length of a first side thereof. A second side of the panel is adjacent to the first side, wherein the angle defined by the intersection of the first and second sides of the panel is an acute angle. A third side of the panel, the side opposite the side of the panel from the first side, may comprise a pliable material attached thereto.

14 Claims, 2 Drawing Sheets

SENTINEL EVENT REDUCTION SYSTEM

The present invention relates to a door/doorway system adapted to significantly reduce or eliminate the occurrence of sentinel events in medical facilities. Specifically, the invention is directed to a door having a particular construction that enables patient privacy but that still reduces or eliminates the physical means for a patient to hang him/herself.

BACKGROUND OF THE INVENTION

Numerous medical facilities are directed full or part time to patients at risk for committing suicide, specifically, by hanging. These suicides, referred to in the industry as sentinel events, often occur in the bathroom of the medical facility were a patient is able to have some privacy. Showerheads, curtain rods, bathroom hooks, and other bathroom hardware have all been converted to break-away devices or other tools to enable a patient to harm themselves or possibly commit suicide. A typical public bathroom may have stall partition walls. These stall partitions themselves pose a threat even if not dismantled. A further significant cause or facilitator of sentinel events is bathroom doors.

Public use bathrooms typically include bathrooms stalls. These stalls include partitions that use bars for rigidity. But even if partitions are removed and replaced with solid walls, or in any bathroom having a door, the doors themselves can be used as a platform or location for holding a belt or a piece of clothing. Inherently, every bathroom on a unit cannot be watched at the same time without enormous staff resources. Therefore, bathrooms, and specifically bathroom doors, provide an area of opportunity for a sentinel event for patients at risk for suicide. To date, the problems of sentinel events in bathrooms are typically addressed by removing all stall hardware and doors. While this reduces opportunities for sentinel events, it likewise eliminates all privacy that a patient may have.

SUMMARY

Accordingly, it is an object of the present invention to overcome the foregoing drawbacks and address the problems described above. The bathroom door described herein has been engineered so that any attempt to use it as a hanging platform will fail. Nothing can hang off the door or be wedged between the door and the doorway without sliding off or falling, because all foreseeable hanging points are removed.

In one example, a sentinel event reduction door comprises a trapezoidally-shaped panel comprising four sides. A continuous hinge is connected to the panel along substantially the full length of a first side thereof. The first side defines a substantially straight line. A second side of the panel adjacent the first side defines a substantially straight line, wherein the angle defined by the intersection of the first and second sides of the panel is an acute angle, and a third side of the panel, substantially parallel to and on the opposite angle. A third side of the panel, substantially parallel to and on the opposite side of panel from the first side, comprises a pliable material attached thereto.

In another alternative, a sentinel event reduction system comprises a door frame defining a door way, and a door hung on the door frame. The door comprises a trapezoidally-shaped panel comprising four sides. A continuous hinge is connected to the panel along substantially the full length of a first side thereof, the first side defining a substantially straight line. A top side of the panel is adjacent the first side, the top side defining a substantially straight line. The angle defined by the intersection of the first and top sides of the panel is an acute angle. The door way has a length and width that are larger than the greatest length and width defined by the door panel, and further wherein openings are defined by the top of the door and the door frame and by the bottom of the door and the door frame.

DETAILED DESCRIPTION

In general terms, a sentinel event reduction system is described herein. The system includes a uniquely-engineered door that is hung in a door frame for use particularly in facilities where there are at risk patients who may hurt themselves or attempt suicide. The door is hung in any conventional door frame. The door has an angled top and a continuous hinge. Further, in at least some examples, a pliable material is attached to the opposite side of the door from the hinge side of the door. The door is dimensioned so that there are substantial openings above and below the door between the door and the door frame.

Figure 1:
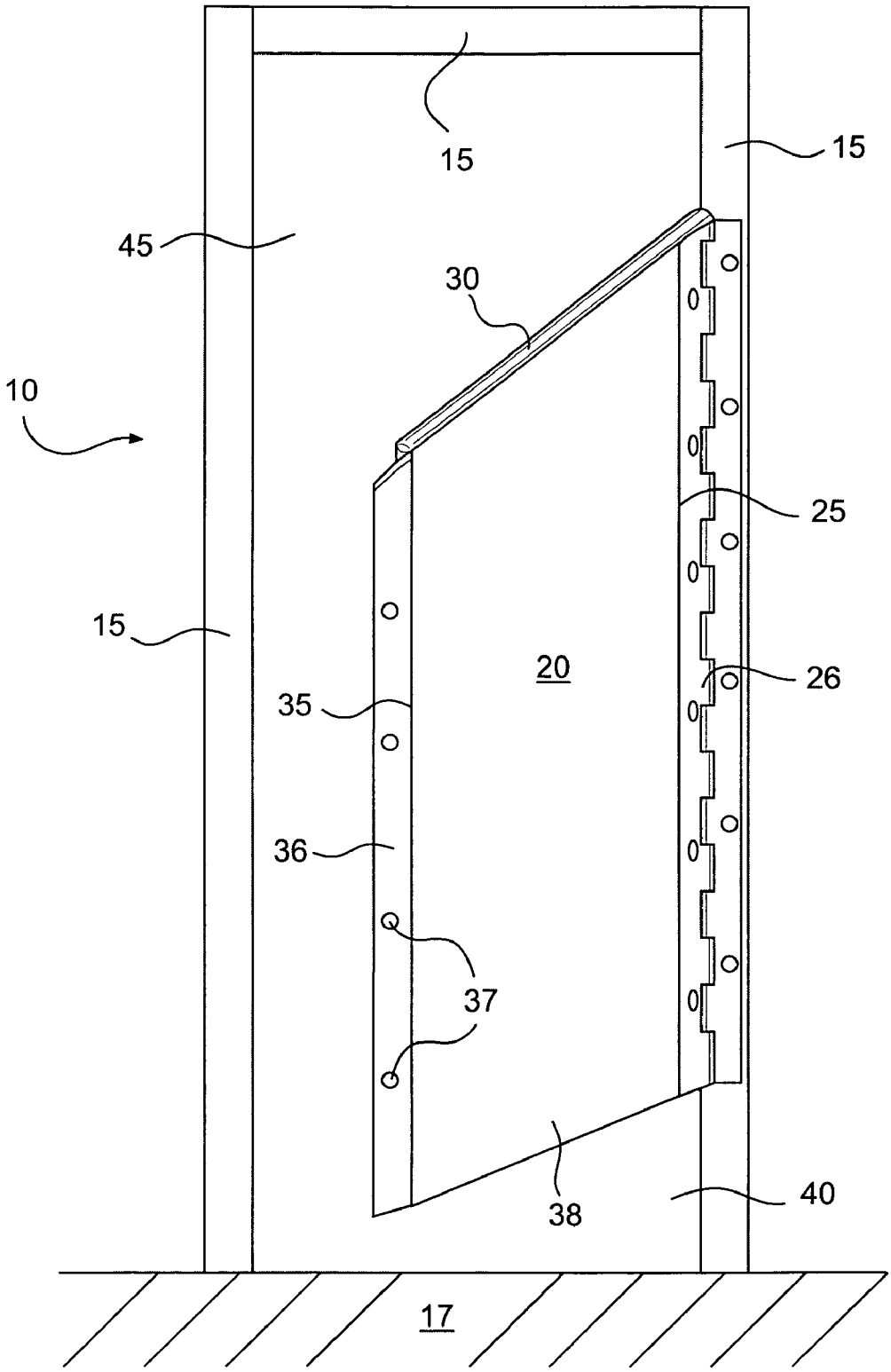
FIG. 1 is a perspective view of a sentinel event reduction system in which the door is shown in an open position.
Figure 2:
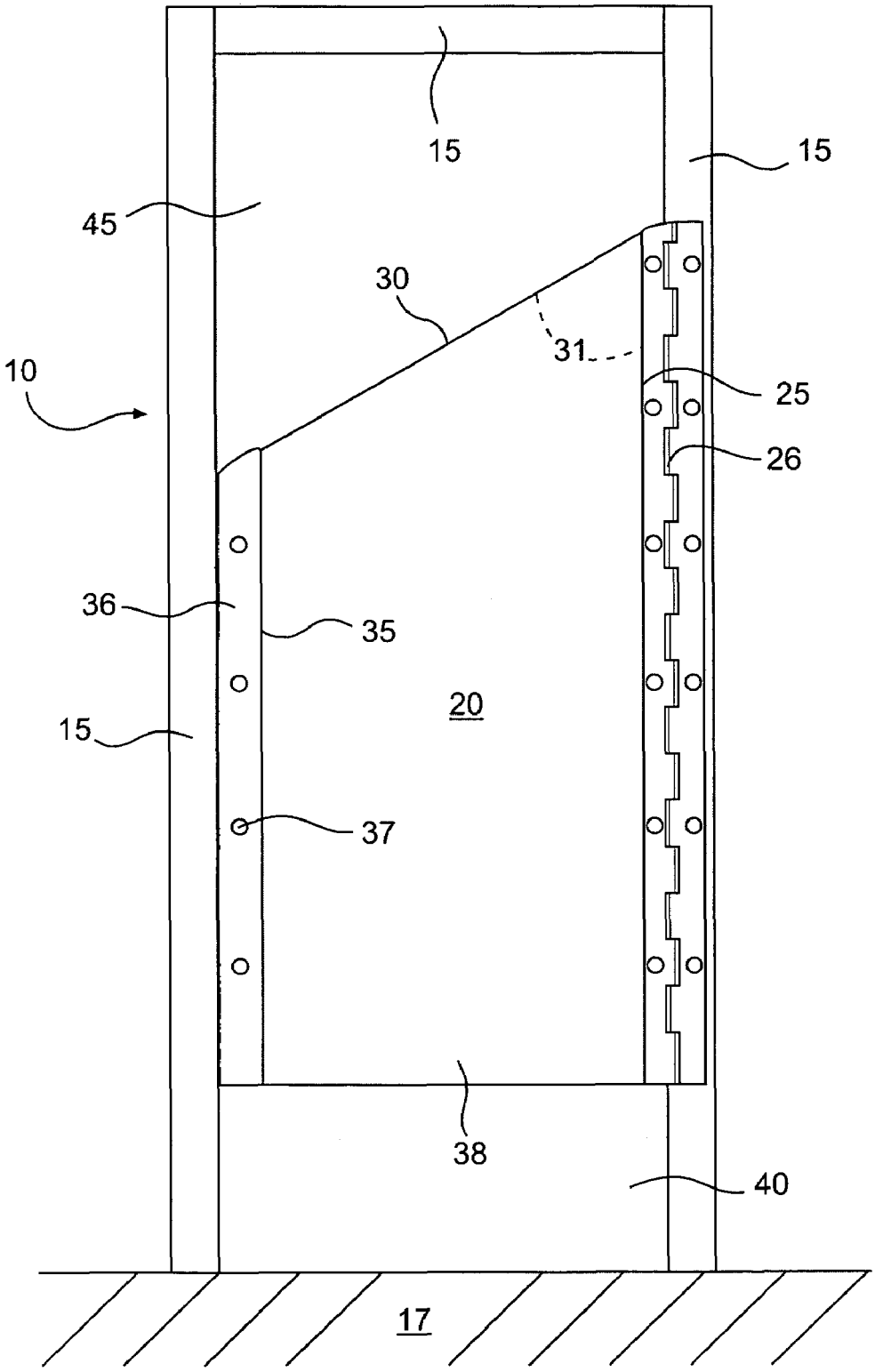
FIG. 2 is a side elevation view of a sentinel event reduction system showing the door in the closed position.

Turning now to FIGS. 1 and 2, the sentinel event reduction system 10 is shown with a door 20 mounted onto one side of a door frame 15. The complete doorway is defined by the door frame 15 and the floor 17. The door 20 is trapezoidally-shaped. A first side of the door 25 is adjacent to and hanging on the door frame 15. The first side 25 includes a continuous hinge 26 that attaches the door 20 onto the door frame 15. This first side 25 of the door 20 is substantially straight to enable the operation of a conventional hinge along substantially the entire length of the first side.

A second or top side 30 of the door 20 is adjacent the first side 25. An acute angle 31 is formed by the intersection of the first side 25 and top side 30 of the door 20. The size of the acute angle 31 is, in one example, between about 45° and 65°. In one example, the acute angle is about 55°. Functionally, it is important that this acute angle 31 create such a slope on the top side 30 of the door 20 as to not allow anything to hang from it without sliding off. The door 20 is made of one or more panel components, and it may be made of any available materials such as metal, wood or plastic, or composites thereof. The functionality of the acute angle 31 may be enhanced with a door material having a low coefficient of friction such as Formica, metal or other smooth polymer material. Also, this top side 30 may be beveled or rounded (as shown in FIG. 1) to enhance the functionality of making it difficult to hang anything on it. The top side 30 is shown in the figures as being substantially straight. Prominent curves along the top side 30 may create flat portions or sections (at least substantially parallel with the floor) that could form a hanging point. Realistically, the top 30 of the door 20 may include some minimal curvature as long as it is sloped across the width of the door so that there is no creation of a hanging point, and the term "substantially straight line" to describe the top side includes slight curvatures.

The third side 35 of the door 20 is opposite the first side 25. The third side 35 is generally parallel to the first side 25 to fit into a conventional, rectangular doorway. The width of the door 20 is less than the width of the doorway so that nothing may be jammed by a patient between the door frame 15 and the third side 35 to form a hanging point. In one example there is at least about a three inch gap between the door frame 15 and the third side 35. To enhance the privacy for a patient or user, it is possible to attach a pliable material 36 along the length of the third side 35. This pliable material 36 creates privacy along that gap between the third side 35 and the door frame 15. However, the pliable material 36 is soft enough that a patient cannot use it as a wedge for creating a hanging point. The pliable 36 material may be a rubber gasket, as shown, or it may be brush material or anything pliable and soft.

The fourth side 38 of the door 20 is the bottom of the door and is shown as perpendicular to the first and third sides, 25 and 35 respectively, and is generally parallel to floor 17. The fourth side 38 is shown as a straight line. This fourth side 38 may be any line that does not facilitate the opportunity for a sentinel event or otherwise formation of a hanging point. Like the tope side 30, the fourth side 38 may be beveled or rounded to enhance the functionality of making it difficult to look anything on it.

There is no hardware shown in the sentinel event reduction system 10 other than the continuous hinge 26 and the screws 37 that attach the gasket 36 to the third side 35. The use of a door handle presents an opportunity for creating a hanging point. If any additional hardware is desired then it must not create any opportunity for formation of a hanging point.

As shown, the doorway defined by the door frame 15 and floor 17 is a conventional rectangular shape. Alternatively, there could be a rounded top or other angled components that make up the doorway. Functionally, it is important that the doorway defined by the door frame 15 and floor 17 is wider and higher than a door as discussed herein. When door 20 is mounted in the door way, openings 40 and 45 are defined below and above the door. These openings 40 and 45 prevent a patient from stuffing a belt, sheet, clothing, shoestring, etc. above or below the door in order to create a hanging point. The top opening 45 is, in one example, at least about 12 inches in height across the entire width of the doorway. As shown, the top opening 45 has a narrowest point where the first side 25 of the door 20 is mounted onto the frame 15. This height is at least about twelve inches, and obviously the height of the opening 45 increases when moving across the width of the door 20. The bottom opening 40 is at least about six inches in height across its width as shown in the figures.

The door and system described herein can be part of an overall sentinel event plan that may be instituted. In order to reduce the opportunities for a sentinel event, the door described herein may be installed in place of other conventional door constructions. At the same time, rather than removing a door all together, the door described herein preserves the privacy and dignity of a patient when using a bathroom.

While the invention has been described with reference to specific embodiments thereof, it will be understood that numerous variations, modifications and additional embodiments are possible, and all such variations, modifications, and embodiments are to be regarded as being within the spirit and scope of the invention.

What is claimed is:

1. A sentinel event reduction door comprising a trapezoidally-shaped panel comprising four sides;

a continuous hinge connected to the panel along substantially the full length of a first side thereof, the first side defining a substantially straight line;

a second side of the panel adjacent the first side, the second side defining a substantially straight line, wherein the angle defined by the intersection of the first and second sides of the panel is an acute angle; and a third side of the panel, substantially parallel to and on the opposite side of the panel from the first side, wherein the third side comprises a pliable material attached thereto the pliable material selected from the group consisting of rubber gasket or a brush material.

2. A sentinel event reduction door as described in claim 1, wherein the angle defined by the intersection of the first and second sides of the panel is in the range of about 45° to about 65°.

3. A sentinel event reduction door as described in claim 1, wherein the angle defined by the intersection of the first and second sides of the panel is about 55°.

4. A sentinel event reduction door as described in claim 1, wherein the pliable material attached to the third side of the panel is a rubber gasket.

5. A sentinel event reduction door as described in claim 4, wherein the rubber gasket has a width of at least about three inches.

6. A sentinel event reduction system comprising;

a door frame defining a doorway;

a door hung on the door frame;

the door comprising a trapezoidally-shaped panel comprising four sides; a continuous hinge connected to the panel along substantially the full length of a first side thereof, the first side defining a substantially straight line; and a top side of the panel adjacent the first side, the top side defining a substantially straight line, wherein the angle defined by the intersection of the first and top sides of the panel is an acute angle;

wherein the doorway has a length and width that are larger than the greatest length and width defined by the door panel and further wherein openings are defined between a top of the door and the door frame and between a bottom of the door and the door frame.

7. A sentinel event reduction system as described in claim 6, wherein the door panel comprises a third side substantially parallel to and on the opposite side of the panel from the first side, wherein the third side comprises a pliable material attached thereto.

8. A sentinel event reduction system as described in claim 6, wherein the angle defined by the intersection of the first and second sides of the panel is in the range of about 45° to about 65°.

9. A sentinel event reduction system as described in claim 6, wherein the angle defined by the intersection of the first and second sides of the panel is in the range of about 45° to about 55°.

10. A sentinel event reduction system as described in claim 6, wherein the pliable material attached to the third side of the panel is a rubber gasket.

11. A sentinel event reduction system as described in claim 10, wherein the rubber gasket has a width of at least about three inches.

12. A sentinel event reduction system as described in claim 6, wherein the opening defined by the top of the door and the door frame has a height of at least about twelve inches across the entire width of the opening.

13. A sentinel event reduction system as described in claim 6, wherein the opening defined by the bottom of the door and the door frame has a height of at least about six inches across the entire width of the opening.

14. A sentinel event reduction system as described in claim 6, wherein the door frame is substantially rectangular-shaped.

* * * * *